United States Patent [19]

Priebs

[11] 4,300,896

[45] Nov. 17, 1981

[54] DEVICE FOR FOLDING MATERIALS TO BE FOLDED

[75] Inventor: Horst Priebs, Bielefeld, Fed. Rep. of Germany

[73] Assignee: HAT-Hohmann GmbH & Co. Automations-Technik, Kommanditgesellschaft, Leonberg, Fed. Rep. of Germany

[21] Appl. No.: 94,210

[22] Filed: Nov. 14, 1979

[30] Foreign Application Priority Data

Nov. 15, 1978 [DE] Fed. Rep. of Germany ..... 2849431

[51] Int. Cl.[3] ..... B65H 45/14

[52] U.S. Cl. ..... 493/419

[58] Field of Search ..... 270/61 F, 68 R, 79; 493/419, 405, 451

[56] References Cited

U.S. PATENT DOCUMENTS

| | | | |
|---|---|---|---|
| 3,106,877 | 10/1963 | Larson | 270/68 R |
| 3,913,906 | 10/1975 | Vits | 270/68 R |
| 4,105,197 | 8/1978 | Pott | 270/68 R |

FOREIGN PATENT DOCUMENTS

| | | | |
|---|---|---|---|
| 1184728 | 1/1965 | Fed. Rep. of Germany | 493/419 |

*Primary Examiner*—J. Reed Fisher
*Assistant Examiner*—A. Heinz
*Attorney, Agent, or Firm*—Herbert L. Lerner; Laurence A. Greenberg

[57] ABSTRACT

Device for folding materials, including a belt conveyor material transport assembly extending over three transport sections, the assembly including three groups of endless belts, the first group of belts being above the three transport sections, the second group of belts being below the first transport section, the third group of belts being below the third transport section and a swing-plate having a surface below the second transport section; a retractable material stop between belts of the third group of endless belts; a device for guiding the swing-plate from a starting position through a 180° turn about the rear edge thereof, a holder swingably supported above the swing-plate with extensions disposed thereon operable to push the swing-plate through the swing of the holder into the starting position; in a double-folding operation, the holder being contactable with the rear edge of the swing-plate, the front edge of said swing-plate forming a first crease in the material, and (the rear edge forming a second crease; guide rollers supporting) the third group of belts at the ends thereof closest to the swing-plate; in a single-folding operation, the guide rollers being swingable between belts of the first group, simultaneously operable exit rollers for additionally creasing the folds in the material; and a sensor on the stop triggerable by the leading edge of the material for shutting off the assembly and synchronizing the swing-plate holder and stop.

2 Claims, 12 Drawing Figures

DEVICE FOR FOLDING MATERIALS TO BE FOLDED

The invention relates to a device for folding materials, in particular advertising material, form sheets, postal items, and the like, with a belt conveyor assembly for moving the items to be folded, and a swing-plate which is swingable about 180° for folding. The swing-plate is disposed in the middle section of three transport sections of the belt transport assembly, and is rotatable about its rear edge which is closest to the third transport section.

In German Published, Prosecuted Application DE-AS No. 24 41 056, a multiple folding device is described in which flexible items that are to be folded are bent around edge that are transversely oriented with respect to the direction of transport, by means of a swing-plate which is swingable about 180°. After the folding operation, the swing-plate is withdrawn from the item that is folded. The withdrawal is to the side, at right angles to the transport direction. It is swung back 180°, and after the folded material is transported away, the swing-plate is again moved back into the transport path.

This known device is suited for folding materials, however it is not capable of creasing the fold. Another disadvantage is that a fast feeding sequence of the items to be folded is not possible, because a sideward withdrawal motion, a back swing around 180°, and a forward motion of the swing-plate are required before the next folding cycle can begin.

It is accordingly an object of the invention to provide a device for folding materials to be folded, which overcomes the hereinafore mentioned disadvantages of the heretofore known devices of this general type, and which not only lays the items down, but also creases them, and which also permits a faster rate of operation.

With the foregoing and other objects in view there is provided, in accordance with the invention, a device for folding materials such as advertising material, form sheets, postal items and the like, comprising: a belt conveyor material transport assembly extending over a first, second and third transport section respectively disposed along the direction of transport of the material to be transported, the assembly including a first, second and third group of endless belts each having an outer surface and an upper and lower run, the outer surface of the lower run of the first group of belts being disposed above each of the three transport sections, the outer surface of the upper run of the second group of belts being disposed below the first transport section, the outer surface of the upper run of the third group of belts being disposed below the third transport section and a swing-plate having an upper and lower surface, one of the surfaces of the swing-plate being disposed below the second transport section; a retractable material stop disposed between belts of the third group of endless belts; means for slideably supporting and guiding the swing-plate from a starting position through a 180° turn about the rear edge thereof which is the edge that is closest to the third transport section and leaving the opposite front edge thereof in position as the rear edge after the turn; a holder swingably supported above the swing-plate and having extensions disposed thereon, the extensions being operable to push the swing-plate through the swing of the holder into the starting position; in a double-folding operation, the holder being contactable with the rear edge of the swing-plate, the front edge of the swing-plate forming a first crease in the material to be folded as the material is pressed against the first group of belts and the swing-plate is turned, and the rear edge forming a second crease; guide rollers supporting the third group of endless belts at the ends thereof closest to the swing-plate; in a single-folding operation, the guide rollers being swingable between belts of the first group of belts so that the rear edge of the swing-plate does not form a crease; simultaneously operable exit rollers disposed in vicinity of the end of the third transport section for additionally creasing the folds in the material as it leaves the device; and sensor means disposed on the stop and being triggerable by the leading edge of the material in transport direction for shutting off the belt conveyor assembly and for synchronizing operation of the swing-plate, holder and stop.

In accordance with another feature of the invention, there are provided comb means for creasing the material in conjunction with the front edge of the swing-plate.

In accordance with a further feature of the invention, the comb-means includes a multiplicity of spaced apart fingers, an angular folder disposed on each finger and an acute-angle notch formed in the angular folder into which the front edge of the swing plate is insertable with the material therebetween.

In accordance with a concomitant feature of the invention, the holder includes a row of curved fingers, and extensions disposed on the fingers which are closest to the ends of the row of fingers.

An important advantage of the new device is the feature that the items to be folded are securely conducted or guided up to the beginning of the folding-and-creasing operation between transport belts, in order to make a fast transport of multi-layered items possible. The device is particularly well suited for the folding and creasing of multi-layered paper sheets of different formats, different paper qualities and surface conditions such as coatings, for example. This general applicability is not achieved by the previously known folding machines. Furthermore, a saving of time is achieved by the feature that the double creasing is effected not by sequential steps, but simultaneously by the forward and rear edges of the swing-plate. Among other features, it is essential to provide for one or several sheets to be folded to have already entered the first transport section, while the previously folded sheet is still in the third transport section.

Other features which are considered as characteristic for the invention are set forth in the appended claims.

Although the invention is illustrated and described herein as embodied in device for folding materials to be folded, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1*a* to 1*d* are diagrammatic view of the work cycle or sequence of the device for double folding material according to the invention;

FIGS. 2*a* to 2*d* are diagrammatic views, similar to FIGS. 1*a* to 1*d*, of the work cycle of the device for single folding;

Figure 1A:
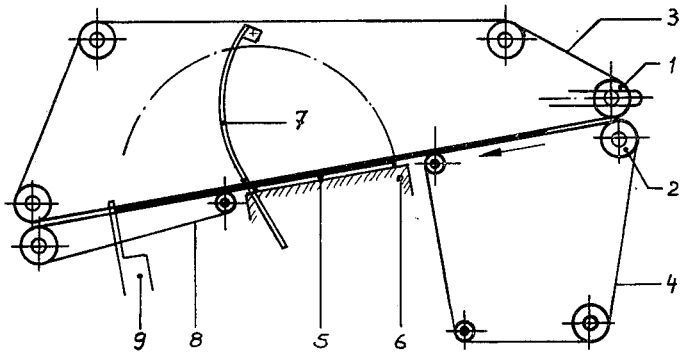

The operation of the folding machine will first be generally discussed with respect to FIGS. 1 and 2 and then the elements which perform the operation will be discussed in detail with respect to FIGS. 3–6.

Referring now to the figures of the drawing and first, particularly, to FIG. 1 when used for double folding, it is seen that the sheets to be folded are brought to the input rollers 1 and 2 by a transport or collecting machine. The sheets are then transported between the endless belts 3 of an upper first group, and the endless belts 4 of a lower second group of belts through a first transporting-section of the device. The sheets are then brought over a swing-plate 5 into a second transport section, where the swing-plate in its initial position lies flat on a table 6. The sheets are next conducted under the holder 7, over the endless belts 8 of a third group of belts in a third transport section, and to a trigger stop 9. During this transport, the sheets which are to be folded are securedly guided by the endless belts 3 of the upper group of belts.

When the sheets hit the trigger stop 9, a conventional sensor which may operate by contact or optically, for example, is activated.

Figure 1B:
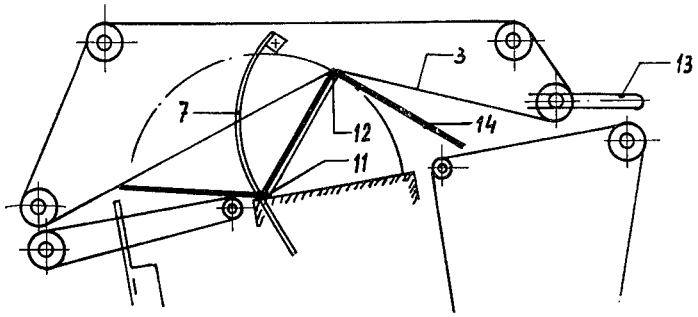

The sensor stops the drive for the endless belts 3,4 and 8 of the three groups of belts and activates the drive for motion of the swing-plate 5 by means of control circuitry. The swing-plate is driven around its rear edge 11 which is disposed toward the third transport section, so that the swing-plate swings counter-clockwise through 180°. The forward edge 12 of the swing-plate 5 thereby lifts the upper group of belts 3 with the sheet 14, as can be seen in FIG. 1*b*. The upper input roller 1, which is supported in the slots 13, makes the lifting of the endless belts 3 possible, whereby these belts press the sheet 14 closely onto the forward edge 12 of the swing-plate 5, and thereby fold the sheet.

Figure 1C:
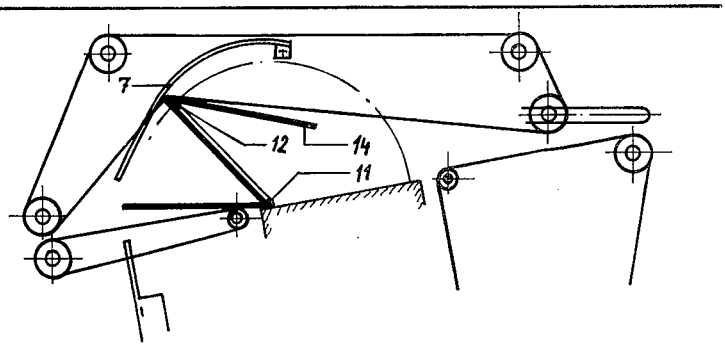
Figure 1D:
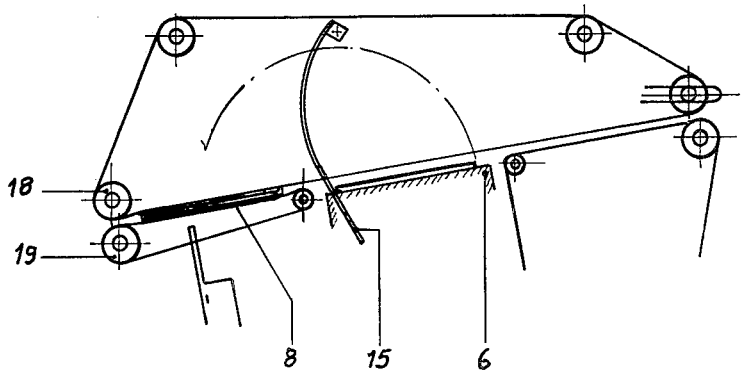

The arc-shaped holder 7 holds the sheet 14 fixed at the rear edge 11 of the swing-plate 5, and thereby also effects the folding of the sheets at this point. In FIG. 1*c*, the motion of the swing-plate 5 has progressed so far that the holder 7 has moved in the forward direction, i.e. the direction of the movement of the sheets, and the sheets 14 at the rear edge 11 and the forward edge 12 are folded in acute angles. Meanwhile the trigger stop 9 has moved downward, out of the transport path, as can be seen from FIG. 1*c*.

After a complete swing through 180°, the swing-plate 5 has deposited the folded sheets on the endless belts 8 of the third belt group, and simultaneously the swing-plate 5 is pushed back to its position on the table 6 as shown in FIG. 1*c*. The swing-plate 5 has been pushed back by the extensions 15 on the holder 7, and the drive of the endless belts 3,4 and 8 is again turned on. Subsequently the folding operation is completed by transporting the creased sheets through output rollers 18 and 19.

The procedure for single folding or creasing will be explained with the aid of FIG. 2.

Figure 2A:
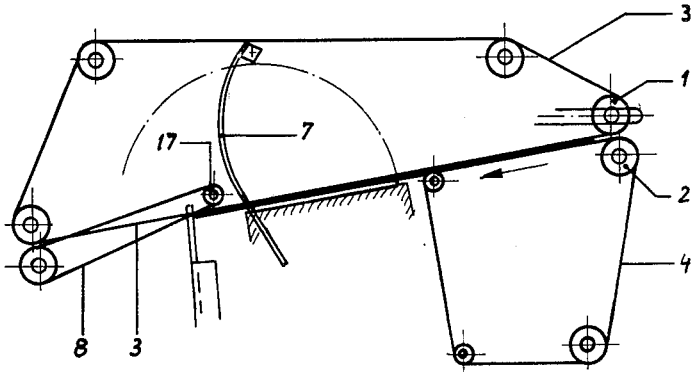
Figure 2B:
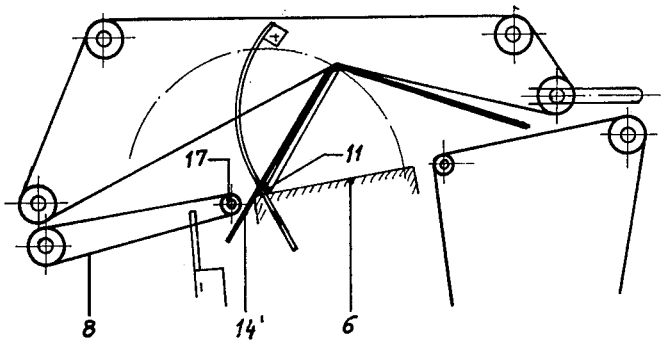

In order to switch-over to single-folding, the endless belts 8 (FIG. 2*a*) of the third belt group are swung upward with their guide roller 17 between the endless belts 3 of the upper group. The belts 8 are swung so far that the sheets from the input rollers 1 and 2, which are delivered between the endless belts 3 of the first upper group and the endless belts 4 of the second lower group, are guided over the swing-plate 5 under the endless belts 8 of the third transport section to the trigger stop 9. When the sheets reach the trigger stop 9, the drive of the endless belts 3, 4 and 8 is stopped, the drive of the swing-plate 5 is turned on, and the swing-plate 5 is moved around its rear edge counter-clockwise 180°. FIG. 2*b* shows that at the beginning of the swing of the swing-plate 5, the endless belts 8 of the third belt group are again moved back to their original starting position. The forward portion 14′ of the sheets 14 which was guided below the endless belts 8 of the third belt group can freely take the shape of the corresponding sheet portion in the interspace between the table 6 and the guiderollers 17. The holder 7 does not obstruct the sheets because it is locked in a raised position when the device is set for single-fold operation, as will be described hereinbelow.

Figure 2C:
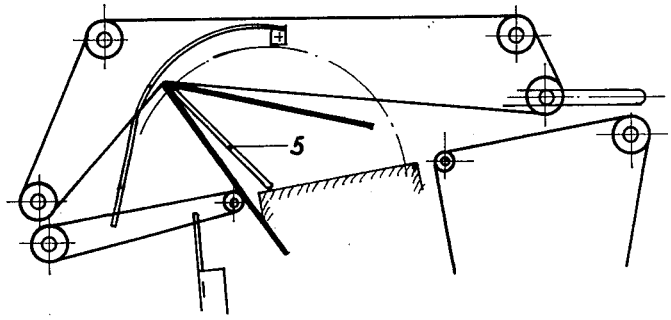
Figure 2D:
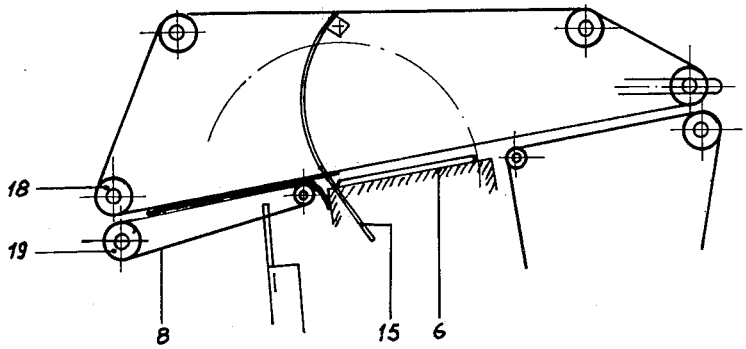

FIG. 2*c* shows the progress of the folding operation, and in FIG. 2*d* the swing-plate 5 has deposited the singly folded sheets onto the endless belts 8. The holder 7 has already pushed the swing-plate 5 back into its initial position on the table 6 by means of its extensions 15, and the singly folded sheets are transported between the endless belts 8 and the endless belts 3 to the output rollers 18 and 19, where the folding operation is completed.

Figure 3:
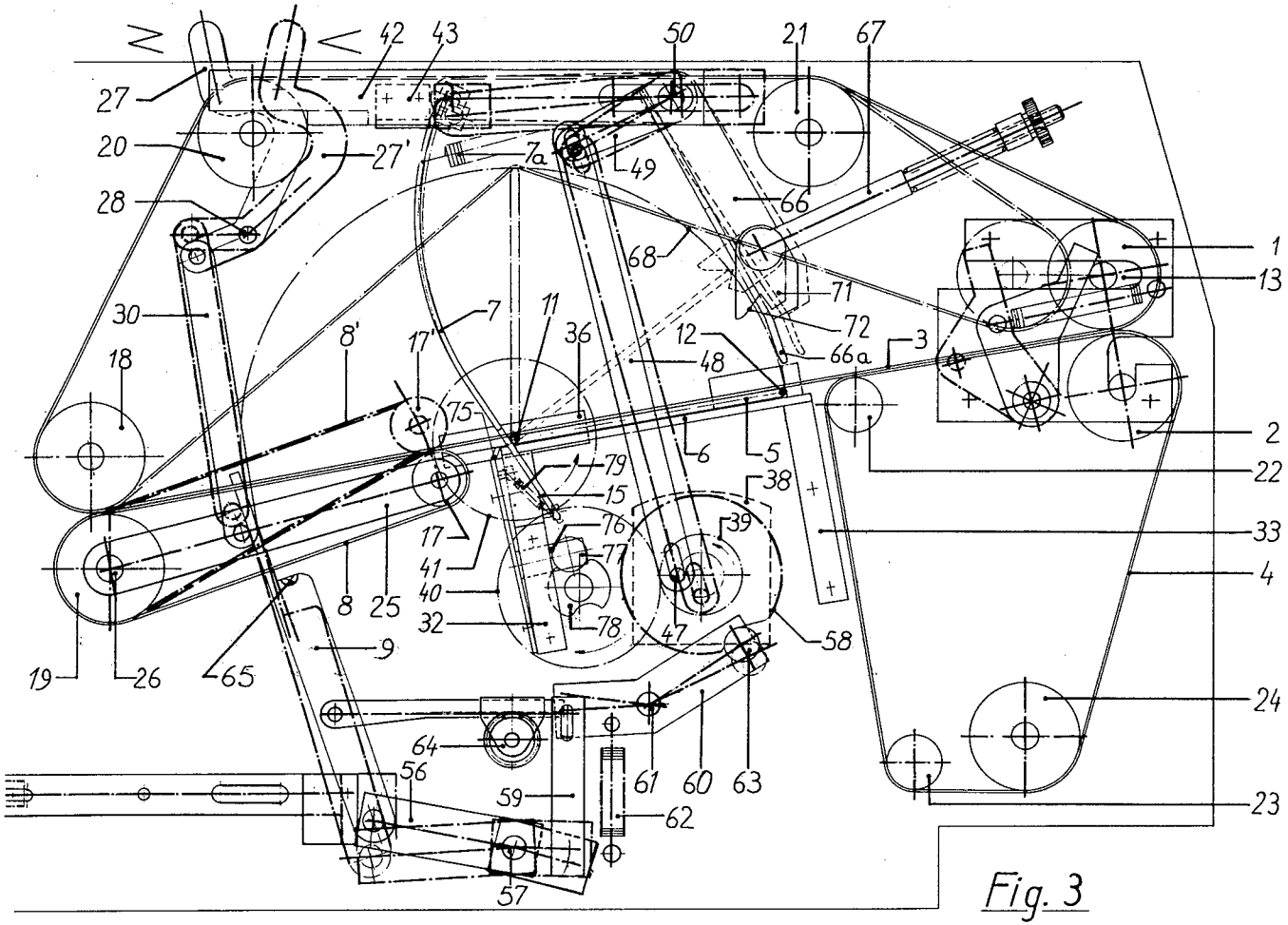
FIG. 3 is a diagrammatic side-elevational view of the folding device.
Figure 4:
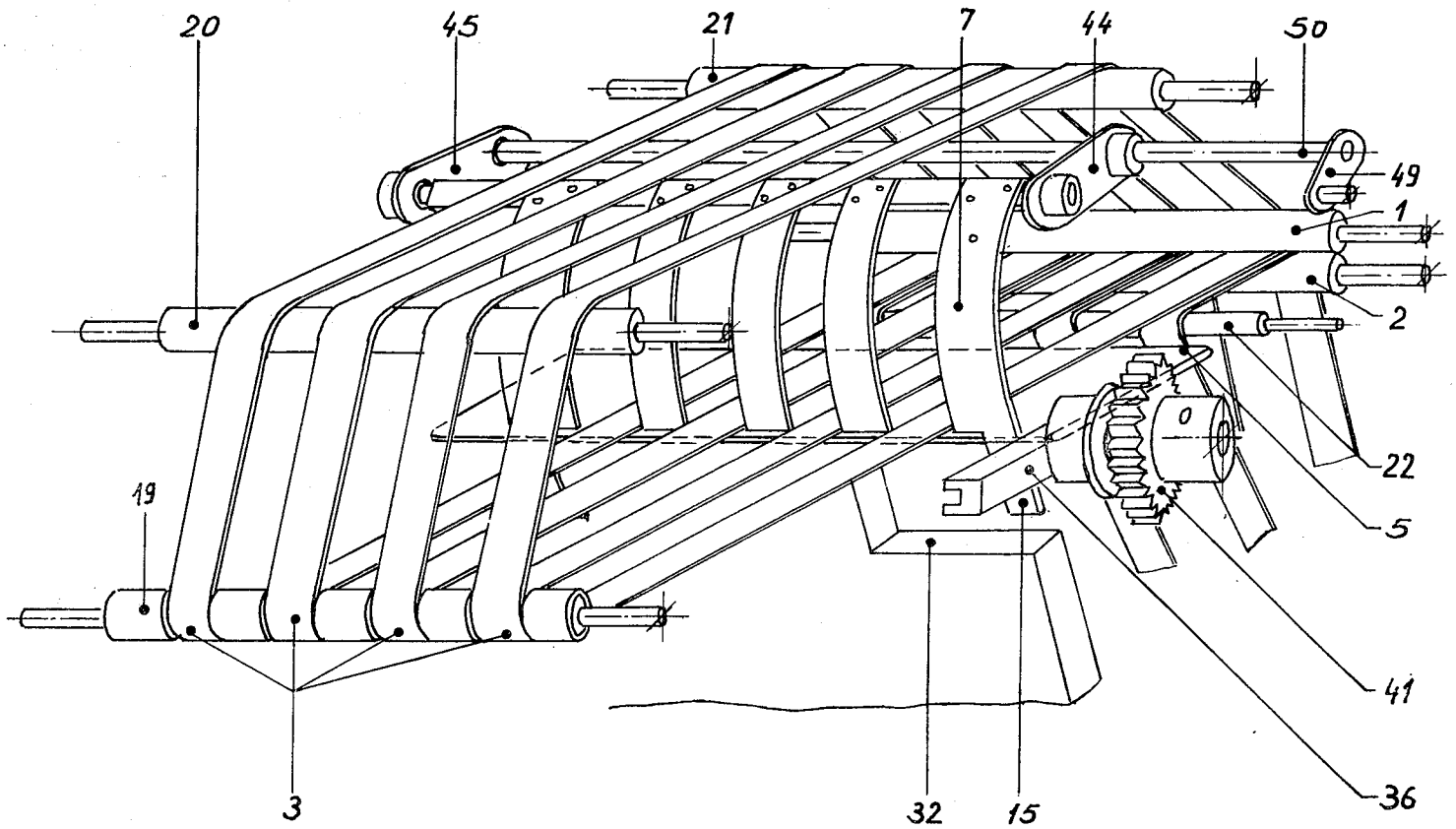
FIG. 4 is a diagrammatic perspective view showing only essential details, as seen in the starting position of the swing-plate according to FIG. 1*a;*

The folding device which is diagrammatically illustrated in FIG. 3 is provided with three groups of endless belts 3,4 and 8 for the transport of the sheets which are to be folded. Each group includes several belts which are mutually parallel and spaced apart. A first upper group of four endless belts 3 is disposed with its lower surface over the entire length of the transport path of the folding device. In particular, the belts 3 travel over an upper input roller 1, an upper output roller 18, and two upper guide rollers 20 and 21 which are also shown in FIG. 4. A second group of four endless belts 4 forms a first transport section of the transport path. The upper surface of the belts 4 is in conjunction with approximately the first third of the lower surface of the upper group of endless belts 3. The second group of endless belts 4 is guided over a lower input roller 2 at the sheet intake, and a guide roller 22 at the outlet of the first transport section, as well as over two guide rollers 23 and 24.

A third group of endless belts 8 is guided over a lower exit-roller 19 and guide rollers 17, and forms a third transportation section of the transport path. The upper surface of the belts 8 are in conjunction with the lower surface of the upper group of endless belts 3. The endless belts 8 of the third group are carried on the lower exit roller 19 and the guide rollers 17 in such a manner that they form a gap with respect to the endless belts 3 of the upper group. The guide rollers 17 are individually supported on arms 25 which are pivotable together around the axis 26 of the lower exit-roller 19. A shift lever 27 which is rotatably supported on a pin 28 is connected to the arms 25 by means of a link 30. When the shift lever 27 is moved from the "double-fold" position toward the left-hand side of FIG. 3, into the "single-fold" position 27' shown in phantom toward the right-hand side of FIG. 3, the lever 27 privots about the pin 28 and the link is pulled upward. The guide rollers 17 with the third group of endless belts 8 are therefore pivoted upward, between the endless belts 3 of the upper group, to the position 17' and 18', respectively, shown in phantom.

Figure 5:
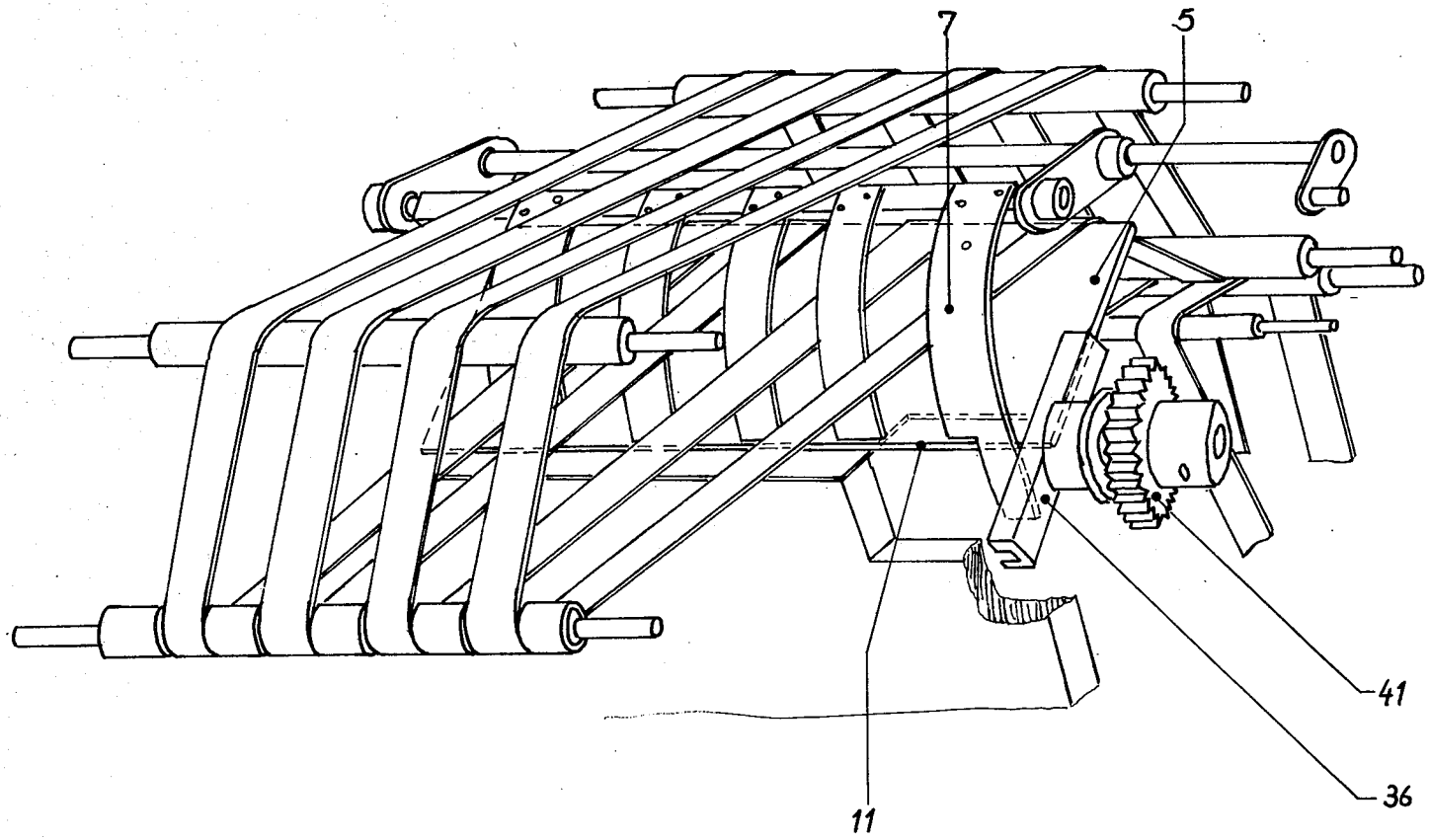
FIG. 5 is a perspective view similar to FIG. 4, shown in the starting position of the swing-plate according to FIG. 1*b*.
Figure 6:
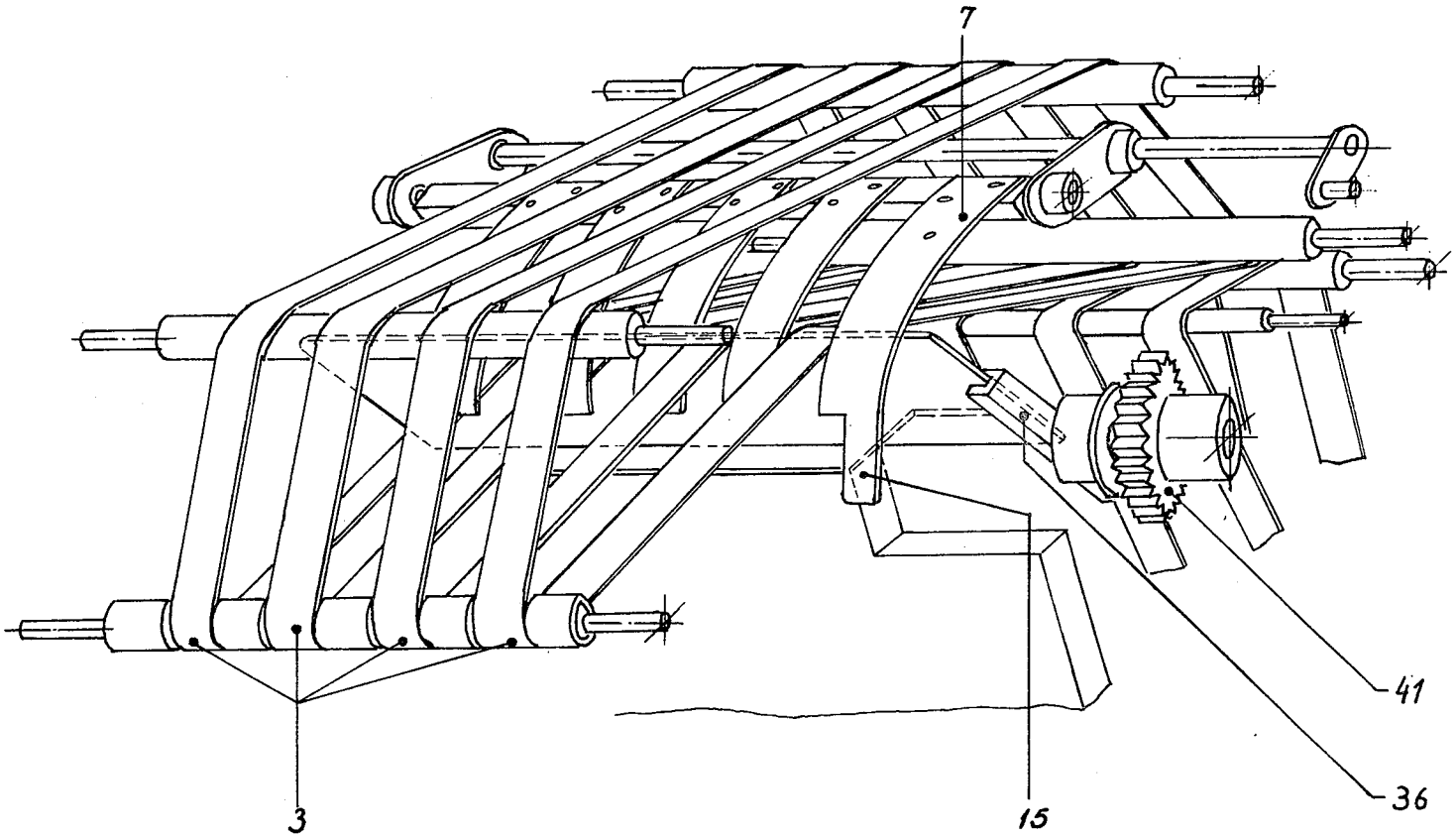
FIG. 6 is another perspective view similar to FIGS. 4 and 5, shown in the advanced position of the swing-plate according to FIG. 1*c*.

In a second transport section between the first and third transport sections, a table 6 is carried on supports 32 and 33. On the table 6 rests a swing-plate 5 whose surface is aligned with the upper surface of the second and third group of endless belts 4 and 8. The swing-plate 5 is slideably supported at the side thereof between two U-shaped guide rails 36. The swing-plate 5 can be swung 180° around its rear edge 11(as seen in the direction of the paper transport). FIGS. 5 and 6 show two positions of the swing-plate 5 which follow each other in folding sequence. The drive of the U-shaped guide rail 36 is effected by a motor 38 having a nonillustrated conventional single revolution clutch, which operates through gears 39, 40 and 41 that have a transmission ratio of 2:1.

A multifingered, curved holder 7 is hingeably supported in a pair of brackets 44, 45 as shown in FIG. 4, and is pulled by a spring 7a shown in FIG. 3, against the swing-plate 5. The outer fingers of the holder 7 have extensions 15 for the purpose of bringing the swing-plate 5 into the position shown in FIG. 3, in which the rear edge 11 is exactly aligned with the pivot axis of the U-shaped guide rails 36.

An eccentric pin 47 is located at the gear 39 which is driven by the motor 38 and the single revolution clutch. The motor 38 moves the holder 7 upward and downward over a pulling-link 48, a lever arm 49 on a shaft 50, and over the pair of guide brackets 44 and 45 shown in FIG. 4. The gear 39 moves the link 48, lever arm 49 and holder 7 into the phantom positions shown in FIG. 3 as it rotates.

A slider 42 is connected to the shift lever 27 and a locking wedge 43 is secured to the slider 42, to latch the holder 7 in the raised position when the shift lever is in "single-fold" position 27'.

The stop 9 is movably supported on a swing-lever 56, and extends with its free end between the endless belts in the third transport section.

Counter-clockwise motion of the swing-lever 56 around its support-pin 57 moves the stop 9 downward and out of the region of the transport path to the phantom position shown for these elements in FIG. 3. This motion is controlled by the cam 58 which is driven by the single-revolution clutch together with the gear 39.

The swing-lever 56 is connected by a link 59 with an angle-shaped or bent lever 60, which is supported on a stationary bearing pin 61. The lever 60 is in contact with the cam 58 by means of a feeler-roller 63 and the force of tension spring 62 which urges the roller 63 against the cam 58. The stop 9 moves up and down as the contour of the cam 58 moves the levers 60 and 56. The position of the stop 9 in the transport path is determined by the format of the sheet which is to be folded, and the setting is effected by the setting member 64 shich adjusts the position of the stop 9. The stop 9 is provided with a sensor 65 which is triggered by the arrival of a sheet at the stop, and controls the stopping of the drive for the endless belts 3,4 and 8 and the engagement of the single revolution clutch at the motor 38 for the motion of the swing-plate 5.

A creasing or folding-comb 66 including five fingers spaced apart from each other is supported on the shaft 50, and is adjusted by an extendable setting device 67 to any desired distance from the path 68 which the front edge 12 of the swing-plate 5 describes when swung around its rear edge 11. In this way, the distance to which the folding comb is set is made dependent on the thickness and the number of sheets which have to be folded at the same time. In each finger of the folding-comb 66, a creasing angular folder 71 having an acute-angled notch 72 is provided. During the motion of the swing-plate 5, the free ends 66a of the folding comb 66 hold down the sheets and fold them in an approximately right angle around the forward edge 12 of the swing-plate 5 which then engages in the notches 72 of the folding angle 71. The creasing or angular folders 71 are tilted by the swing-plate 5, and the notches 72 fold the sheets tightly around the forward edge 12, thereby finishing the folding operation. The movement of the ends 66a, the angles 71, notch 72 and comb 66 is effected between the solid line and phantom positions shown in FIG. 3.

On the support 32 of the folding table 5 there is a counter-support bracket 75 which is slideably disposed perpendicularly to the transport path. A feeler-roller 77 is disposed on a roller-carrier 76 which is in fixed connection with the counter-support bracket 75. The feeler-roller 77 contacts a cam disc 78 which, in conjunction with gear 40, makes a half revolution during each folding cycle. A tension spring 79 pulls the curved, free end of the counter-support bracket 75 against the rear edge 11 of the swing-plate 5. During each half revolution of the cam disc 78, the counter support bracket 75 is lifted by the cam 78 and roller 77, to aid in the folding of the sheet or sheets when the holder 7 swings upward and sideways by the action of the swing plate 5 as shown in FIG. 1c.

There is claimed:

1. Device for folding materials, comprising:

means for transporting the material along a substantially horizontal transport path including, a belt conveyor material transport assembly extending over a first, second and third transport section respectively disposed along the direction of transport of the material, said assembly including a first, second and third group of individual endless belts each having an outer surface and an upper and lower run, said outer surface of said lower run of said first group of belts being disposed above each of said three transport sections, said outer surface of said upper run of said second and third group of belts respectively conveying the material through said second and third transport sections, and a swing-plate having an upper and lower surface, a rear edge being closest to said third transport section and a front edge opposite said rear edge, one of said surfaces of said swing-plate being disposed below the transport path;

a retractable material stop disposed between said individual belts of said third group of endless belts;

means for rotatably supporting and guiding said swing-plate about an axis adjacent said rear edge from a starting position wherein said front edge thereof is in a given position through a 180° turn about said rear edge thereof and returning said opposite front edge thereof to said given position after the turn;

a holder supported above said swing-plate which is movable through a given swing and having extensions disposed thereon, said extensions cooperating with said swing-plate to return said swing-plate to said starting position;

in a double-folding operation, said holder being contactable with said rear edge of said swing-plate, said front edge of said swing-plate forming a first crease in the material to be folded as the material is pressed against said first group of belts and said swing-plate is turned, and said rear edge forming a second crease;

guide rollers supporting said third group of endless belts at an end thereof closest to said swing-plate;

in a single-folding operation, said guide rollers being swingable between individual belts of said first group of belts for preventing said rear edge of said swing-plate from forming a crease;

simultaneously operable exit rollers disposed subsequent to said third transport section relative to the direction of transport for additionally creasing the folds in the material as it leaves the device;

sensor means disposed on said stop and being actuatable by the leading edge of the material in the transport direction for shutting off said belt conveyor assembly and for synchronizing operation of said swing-plate, holder and stop; and comb means for folding the material around said front edge of said swing-plate, said comb means including a multiplicity of spaced apart fingers, each finger including an angular folder having an acute-angle notch formed therein into which said front edge of said swing-plate is insertable with the material there between.

2. Device according to claim 1, wherein said holder includes a row of curved fingers, and extensions disposed on said fingers which are closest to the ends of said row of fingers.

* * * * *